US006938281B1

(12) United States Patent
Tudor

(10) Patent No.: US 6,938,281 B1
(45) Date of Patent: Sep. 6, 2005

(54) FOLDABLE SPA COVER AND LIFT UNIT

(76) Inventor: E. Jess Tudor, 924 Mendolia Way, Central Point, OR (US) 97502

( * ) Notice: Subject to any disclaimer, the term of this patent is extended or adjusted under 35 U.S.C. 154(b) by 0 days.

(21) Appl. No.: 10/673,603

(22) Filed: Sep. 29, 2003

Related U.S. Application Data

(63) Continuation-in-part of application No. 10/071,746, filed on Feb. 8, 2002, now Pat. No. 6,634,036.

(51) Int. Cl.[7] ..... E04H 4/06
(52) U.S. Cl. ..... 4/498; 4/496; 4/580
(58) Field of Search ..... 4/498, 503, 496, 4/580, 581

(56) References Cited

U.S. PATENT DOCUMENTS

| | | | | |
|---|---|---|---|---|
| 4,853,985 A | | 8/1989 | Perry | |
| 4,857,374 A | | 8/1989 | Perry | |
| 5,048,153 A | * | 9/1991 | Wall et al. | 4/498 X |
| 5,086,525 A | | 2/1992 | Christopher | |
| 5,131,102 A | | 7/1992 | Salley et al. | |
| 5,634,218 A | * | 6/1997 | Ouelette | 4/498 |
| 5,689,841 A | | 11/1997 | Black et al. | |
| 5,819,332 A | * | 10/1998 | Perry | 4/498 |
| 5,974,599 A | | 11/1999 | Tudor | |
| 6,158,063 A | | 12/2000 | Tudor | |
| 6,442,799 B1 | * | 9/2002 | Duarte et al. | 4/498 X |
| 2003/0150054 A1 | * | 8/2003 | Tudor | 4/498 |

OTHER PUBLICATIONS

Sta–Warm Industries Ltd., Advertisement in "Canadian Pool & Spa Marketing," Winter 1986.

JVM International Corporation, Advertisement in "Spa Trade Journal and Savna" 1985.

Starlife Leisure Products, Inc., Advertisement in "Aqua," Jul. 1990.

* cited by examiner

*Primary Examiner*—Gregory L. Huson
*Assistant Examiner*—Kathleen J. Prunner
(74) *Attorney, Agent, or Firm*—Richard Esty Peterson

(57) ABSTRACT

A combination foldable spa cover and lifting device including a folding spa cover with integral lifting sockets and a lifting device having a pair of first ends pivotally connectable to a spa structure, and second ends having engagement shafts keyed to the lifting sockets such that a folded spa cover is easily lifted and displaced to one side of the spa structure by pivot of the lifting device and transport of the folded spa cover.

18 Claims, 6 Drawing Sheets

FOLDABLE SPA COVER AND LIFT UNIT

This application is a continuation-in-part of our application of the same title, Ser. No. 10/071,746, filed Feb. 8, 2002, now U.S. Pat. No. 6,634,036, issued Oct. 21, 2003.

BACKGROUND OF THE INVENTION

This invention relates to improvements in spa covers with lifting devices and combines a spa cover and a lifting device, preferably of the type disclosed in my U.S. Pat. No. 5,974,599, issued Nov. 2, 1999. The spa cover lifting device of the referenced patent was further improved in U.S. Pat. No. 6,158,063, issued Dec. 12, 2000, which includes a spring assist for the pivotal lifting device that is preferred for the combination spa cover and lift unit of this invention.

The foldable spa cover and lift unit of this invention integrates the lifting device with a foldable spa cover to improve the appearance and functionality of the combination. In addition, the combined unit insures that the design of the lifting mechanism is coordinated with the design of a particular foldable spa cover.

Where a spa has an outer cabinet or housing spaced from an inner water container, an improved mounting system enables the mounting bracket for the side arms to be concealed by mounting to the inside of the cabinet or housing structure. The feature improves both the appearance and functionality of the spa cover and lift unit. The pivot mechanism is protected from the elements and the spring assist is isolated from inadvertent contact.

Spa covers come in a variety of different configurations adapted to conform to the open top of a spa. Typically, a heated spa has a spa structure or housing that supports an insulated spa cover to retain the heat of the spa water during periods of non-use. A conventional spa cover comprises a thick, insulated foam pad covered with a protective, impervious casing. Because the spa cover can become unwieldy, the modern spa cover is typically foldable along a center fold to facilitate removal and replacement. This folding feature of the modern spa cover was used to advantage in the spa cover lifting devices described in the referenced patent Nos. 5,974,599 and 6,158,063. A spa cover lifting device eases the burden of removing and replacing the spa cover by use of a pivoting lifting frame that is connected to the spa structure.

In previous embodiments the lifting device has a cross member that spans the spa cover and takes advantage of the fold in the cover to engage the cover when lifting the folded cover to a convenient vertical storage position or returning the folded cover from the storage position to the top of the spa. In such a system the lifting frame has two arms that are pivotally mounted to the spa structure and support a cross member over the top of the spa cover. Although not fixed to the spa cover, the lifting frame is effectively connected to the cover when the cover is folded over the cross member of the frame. During periods of non-use, when the cover is unfolded and lying flat on the top of the spa structure, the cross member rests on the top of the cover and detracts from the appearance of the cover. In certain instances the weight of the cross member and lifting arms can deform the top of the cover. Additionally, when the spa cover lifting frame is sold as a kit, the frame must be provided with adjustment mechanisms in order to adapt the frame to a particular cover and spa structure.

The integrated spa cover and lifting device of this invention enables the spa cover to be engaged at the sides thereby eliminating the unattractive and potentially damaging cross member. Additionally, with a part of the lifting mechanism incorporated into the cover, an adjustable cross member is not required and the frame parts are reduced in number and cost. In preferred embodiments of the improved combination spa cover and lifting device, the spa cover includes engagement sockets having a keyway for keying the lifting frame to the spa cover. In this manner, the spa cover and lifting device are sold as a package. This ensures that the lifting device sold with the spa cover is an authorized device and designed to maximize style and operability.

In the embodiments having the concealed mounting brackets for the side arms, the mounting brackets can be pre-mounted in the spa structure to integrate the lifting device with the spa as well as with the cover. This integration of authorized components can be issued by inclusion of a keyway in the mounting bracket. In this manner, the integrated assembly can be sold as a unit, or, the cover and spa can be sold with plugs in the lift arm sockets, and the lift device offered as an option. Later installation requires removal of the plugs and insertion of the keyed side arms.

These and other features of the improved spa cover and lift unit will become apparent from the following summary and detailed description of the preferred embodiments.

SUMMARY OF THE INVENTION

The foldable spa cover and lift unit of this invention combines a foldable spa cover with an integral lifting mechanism for conveniently removing and replacing an insulated covering for a heated spa.

The term "spa" is used to generally describe a hot tub or other bath facility with a whirlpool that is customarily used at home or in an apartment or condominium complex. In general, the volume of water in the spa is maintained heated for an extended period of time and it is therefore desirable to cover the spa with a cover that provides thermal insulation for the heated water to reduce the cost of reheating the water to the desired temperature. In addition, the insulated spa cover provides protection of the contained water from contamination with debris.

The lifting mechanism includes a frame apparatus that is in part pivotally connected to the spa structure or housing of the spa. The frame apparatus preferably has telescopic side elements as disclosed in the referenced patents to permit adjustment of the frame apparatus to fit spas of different size and configuration.

A conventional spa is typically constructed with an inner water container with external water heating and circulating systems to circulate heated water in the container. The inner container and circulating conduits are typically housed in a cabinet or in a support pedestal which provides an exterior surface for attaching the lifting apparatus. Details of the internal construction of the spa are omitted in this description as being unnecessary to the structure and operation of the combination spa cover and lift unit of this invention.

When the lifting apparatus is attached to the interior surface of the housing, where the spa has an outer housing spaced from an inner water container as in most modern spas, the mounting brackets for the side arms can be concealed for added safety and improved appearance. In such instance, a limited description of the internal construction is necessary to illustrate a structurally sound interconnection.

The spa cover used in this invention is a folding type that includes a thick, padded cover piece that is essentially provided in two half segments connected together by a hinge seam for folding to facilitate the removal, replacement and storage of the cover. At least one of the segments of the folding cover includes an internal cross support to prevent the cover from sagging when spanning a spa structure. In this invention the supporting internal cross member in at least one of the cover segments is utilized for anchoring an interconnection mechanism for engaging the distal ends of the arm members of the frame apparatus. The lifting device not only assists in removal and replacement of the cover, but is designed to conveniently store the folded cover in a suspended vertical position at the side of the spa to preserve the form of the cover piece and maintain the cover in an elevated position above the ground. The lifting device thereby minimizes the handling of the spa cover during use of the spa which avoids damage and greatly extends the useful life of the cover. These and other advantages will become apparent upon a consideration of the detailed description that follows.

DETAILED DESCRIPTION OF THE PREFERRED EMBODIMENTS

Figure 1:
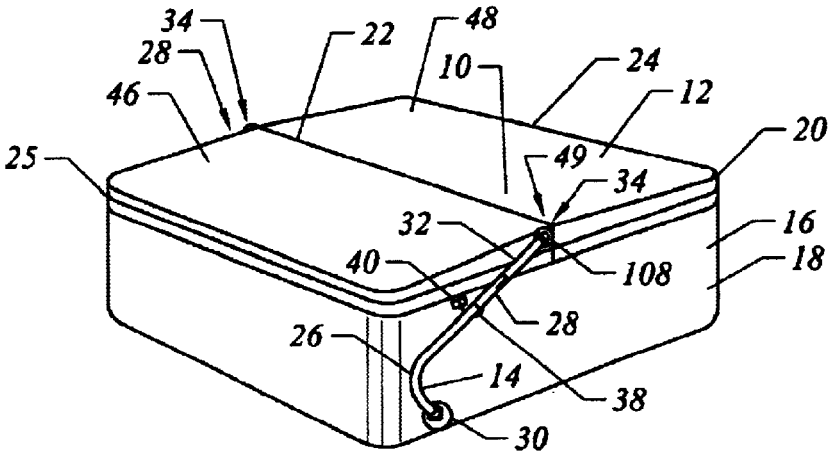
FIG. 1 is a perspective view of the foldable spa cover and lift unit installed on a spa structure.

The combination foldable spa cover and lifting device is shown in FIG. 1 as a unit and designated generally by the reference numeral 10. The spa cover and lifting unit 10 includes a foldable spa cover 12 and a lifting device 14 installed on a typical spa 16. The spa 16 includes a generally rectangular housing structure forming an outer cabinet 18 to which the lifting device 14 is mounted and a perimeter top 20 on which the spa cover 12 is seated.

The foldable spa cover in FIG. 1 is shown in its unfolded position covering the perimeter top 20 of the spa 16. The cover is fabricated of a thick insulating material covered with a weather resistant and water impervious sheeting material. To minimize the weight of the spa cover 12, the thickness of the cover tapers from the center fold 22 to the outer edges 24. The spa cover 12 preferably includes a perimeter skirt 25 along the perimeter top 20 to improve the insulating seal of the spa cover 12 when seated on the spa 16.

The spa cover lifting device 14 comprises a frame apparatus 26 with a pair of side arms 28 pivotally mounted on brackets 30 on each of two opposing sides of the spa housing 18. The mounting brackets 30 are preferably of the type disclosed in my patents No. 5,974,599 and 6,158,063. It is to be understood that other configurations of the side arms 28 and mounting brackets 30 can be provided for the spa cover and lifting unit 10 of this invention.

The side arms 28 of the frame apparatus 26 include a distal end 32 having a shaft assembly 34 that engages a socket assembly 36 (not visible) allowing opposite sides of the folded spa cover to be pivotally engageable with the side arms 28 for lifting a folded spa cover 12 from the spa housing 18 when placing the spa cover into its storage position. To limit the travel of the frame apparatus 26, the lifting device 14 includes a pair of tethers 38 which are attached to the pivotal side arms 28 and anchored to the housing structure 18 by a tether bracket 40. The spa cover 12 includes two cover segments 46 and 48 which are first folded together before the frame apparatus 26 is lifted in an arcuate path to the storage position shown in FIG. 8. Different embodiments of the spa cover and lifting unit 10 having alternate means of pivotally interconnecting the side arms 28 of the frame apparatus 26 to opposite sides of the spa cover 12 are disclosed in FIGS. 2–5.

The combination of the spa cover 12 and the lifting device 14 includes an interconnection mechanism 44 that joins the two components into the integral cover and lift unit 10 of this invention. The interconnection mechanism 44 in the preferred embodiments pivotally joins the shaft assembly 34 and socket assembly 36 with a keyed interconnection to ensure that the frame apparatus 26 includes the approved design of the lifting device 14 for the cover and lift unit 10.

Figure 2:
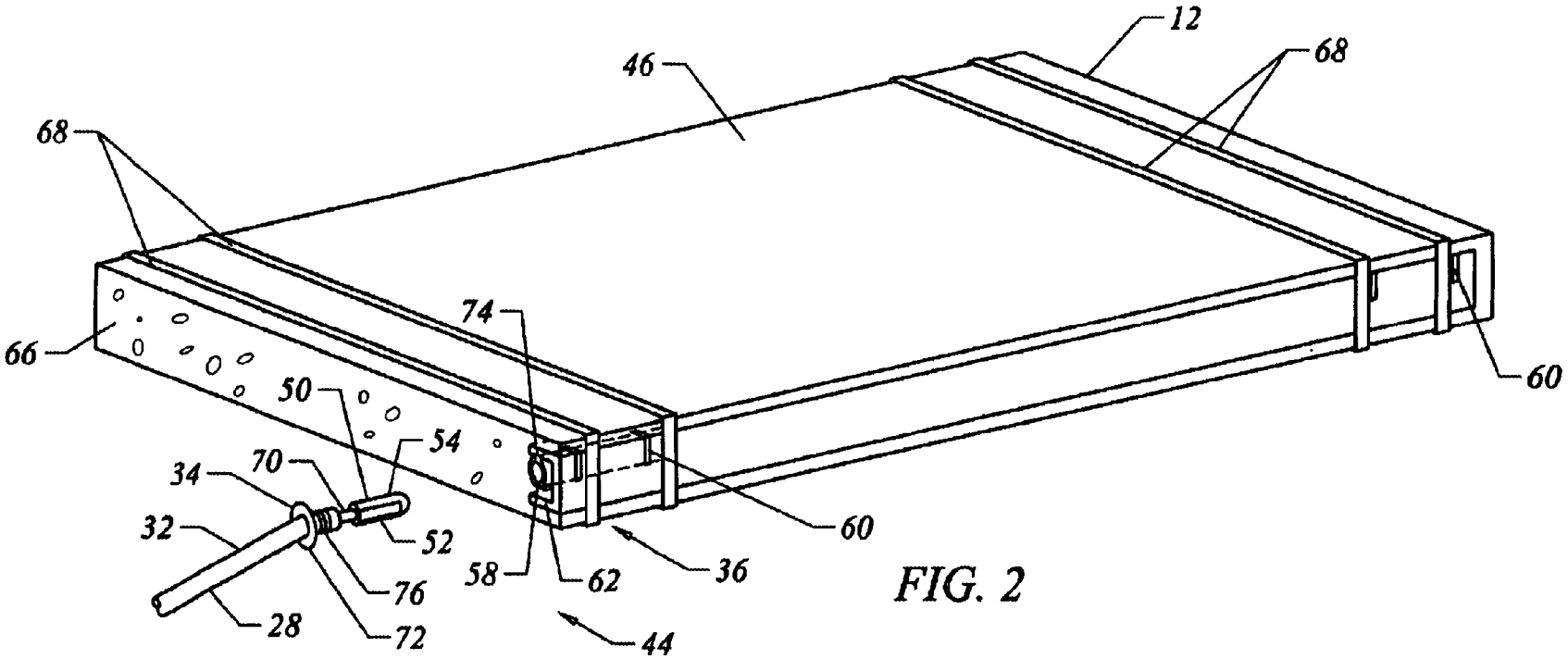
FIG. 2 is a perspective view, partially in cross-section, of a half-cover segment of the spa cover with a first embodiment of an interconnection mechanism between the spa cover and the lifting device for the spa cover and lift unit of FIG. 1.

Referring now to FIG. 2, one embodiment of the interconnection mechanism 44 is shown with reference to one of the half-cover segments 46 of the spa cover 12. The other half-cover segment 48, shown in FIG. 1 is fabricated without the interconnection mechanism 44 and is simply carried by the mechanized half-cover segment 46 when folded on top of the half segment 46 and displaced by the lifting device 14. The lifting device 14 includes a pair of side arms 28 with the distal end 32 connected to the shaft assembly 34 in the form of a cylindrical pin 50 having a keyway 52 in the form of a groove along the end portion 54 of the pin 50 that engages a cooperating projecting key 56 in the socket assembly 36, as shown in the cross section of FIG. 3A. The socket assembly 36 is constructed with a cylindrical tube segment 58 that has a mounting bracket 60 fixed to a rigid U-channel 62 embedded into the insulating core 66 of the half-cover segment 46. The rigid U-channel 62 provides a stiffener for the spa cover 12 and in combination with the side arms 28 forms completes the frame apparatus 26. The rigid U-channel 62 is secured to the core 66 of the half-cover segment 46 by tape 68 that encircles the core 66 and U-channel 62 at a plurality of locations. It is to be understood that other means can be utilized to incorporate the U-channel 62 to the half-cover segment 46 of the spa cover 12. The core 66, U-channel 62 and tape 68 are encased in a covering material such as vinyl to protect the internal parts of the spa cover from the elements.

To ensure that the pin 50 of the shaft assembly 34 can pivot with respect to the keyed tube segment 58, which functions as a bearing, the pin 50 has a necked-down segment 70 having a depth approximately equal to that of the depth of the keyway groove 52. The short key 56 is wholly positioned in the necked-down segment 70 when the pin 50 is fully inserted into the tube segment 58. In such position, the flange 72 at the base of the projecting pin 50 abuts the end 74 of the tube 58. It is to be understood that the pin 50 could include a projecting key and the tube segment 58 include an inside groove as a keyway with similar effect.

In addition, the interconnection mechanism 44 includes a means for maintaining the longitudinal position of the pin 50 in the tube segment 58. This is provided by a semi-circular groove 76 around the pin 50 located adjacent to but displaced from the flange 72. This groove 76 is engaged by an O-ring 78 as shown in the cross-sectional view of FIG. 3B.

Figure 3A:
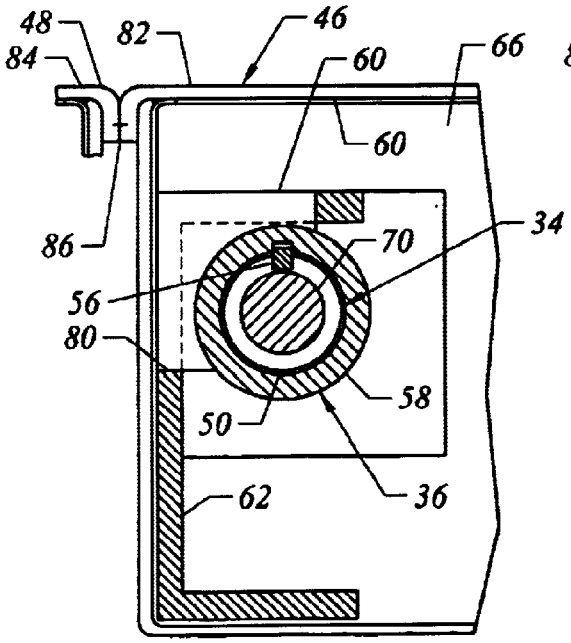
FIG. 3A is a first cross-sectional view of a portion of the interconnection mechanism of FIG. 2 with the shaft assembly in engagement with the socket assembly.
Figure 3B:
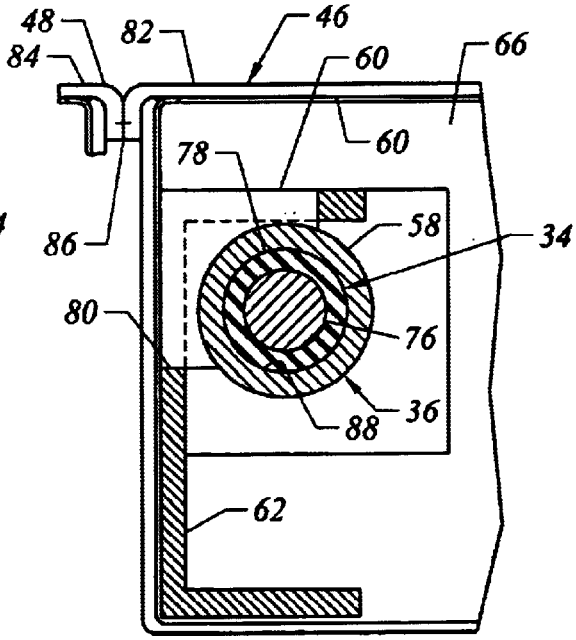
FIG. 3B is a second cross-sectional view of a portion of the interconnection mechanism of FIG. 2 with the shaft assembly in engagement with the socket assembly.

In FIGS. 3A and 3B, the cross-sectional representations depict the shaft assembly 34 fully installed into the socket assembly 36. In FIG. 3A, the necked-down segment 70 of the pin 50 locates the projecting key 56 wholly within the necked-down segment 70 enabling the tube segment 58 to pivot relative to the pin 50. As shown in FIG. 3A, the bracket 60 is secured into a slot 80 in the U-channel 62 to fix the position of the tube segment 58 relative to the half segment 46 of the spa cover 12. As described, the core 66 is wrapped by tape 68 and encompassed in a casing 82 of rugged, impervious and weather resistant material such as a vinyl and cloth composite. The casing 82 of the first half-cover segment 46 is coupled to the casing 84 of the other or second half-cover segment 48, shown in part, by a seam 86 which provides a hinge for folding the carried segment over the carrier segment. In general, a single U-channel 62 is required to support the two half-cover segments 42 and prevent the segments from sagging when spanning the open top 20 of the spa 16.

In FIG. 3B, the cross-section is taken at the O-ring 78 which engages the semi-circular groove 76 in the pin 50 and the groove 76 around the pin 50. In this manner the pin 50 can be pressed into the tube segment 58 with the O-ring releasably engaging the pin 50 to permit relative rotational movement, but to restrict relative axial displacement of the pin and tube segment in the interconnection mechanism 44. At least one of the two sets of pin and tube segment combinations includes a key and keyway elements to insure that the approved lifting device is used with the spa cover.

Figure 4:
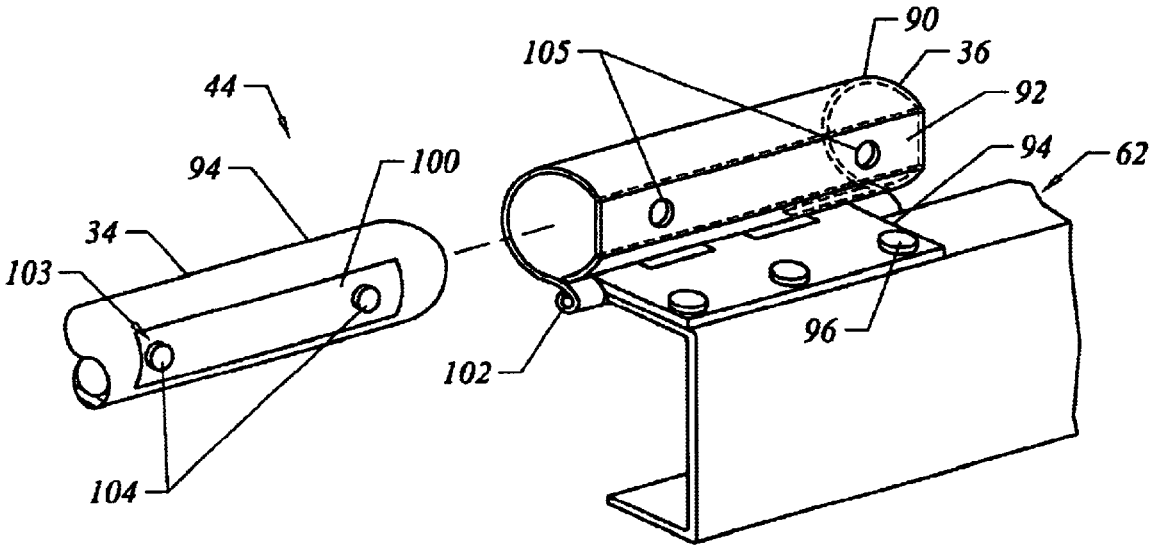
FIG. 4 is a perspective view of a second embodiment of an interconnection mechanism of FIG. 1 illustrating the manner of interconnecting the shaft assembly with the socket assembly.
Figure 5:
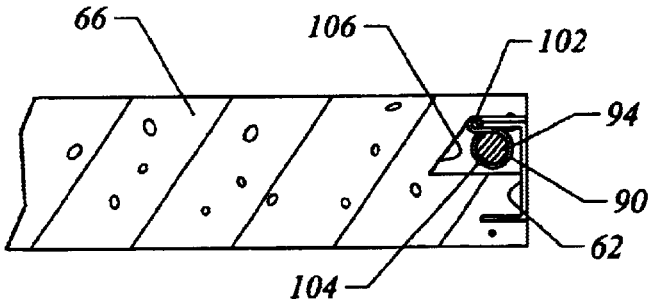
FIG. 5 is a partial cross-sectional view of the interconnection mechanism of FIG. 4.
Figure 6:
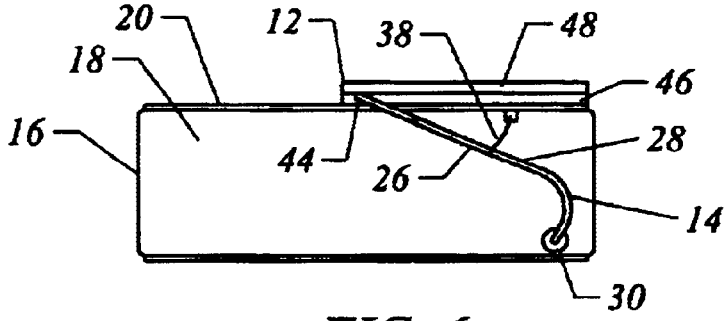
FIG. 6 is a side elevational view of the spa cover and lift unit installed on a spa structure illustrating a first position in displacing the folded spa cover from the spa structure.

Referring now to FIGS. 5 and 6, a second embodiment of the interconnection mechanism 44 for the coupling of the spa cover 12 and lifting device 14 is shown. In the partially exploded view of FIG. 4, the interconnection mechanism includes a socket assembly 36 in the form of a tube segment 90 having a flattened portion 92 hinged to a mounting plate 94 that is fixed to the end of the rigid U-channel 62 by rivets 96. The tube segment 90 of FIG. 4. is shown in an uplifted position for purposes of illustration in depicting how the flattened portion 92 provides a keyway for the co-operating pin 94 at the distal end 32 of the side arm 28. The pin 94 includes a complimentary flattened portion 100 when inserting the shaft assembly 34 into the socket assembly 36 with the flattened portion 100 of the pin 94 aligned with the flattened portion of the tube segment. Normally, as shown in FIG. 5, the tube segment 90 is tucked under the rigid U-channel 62 allowing limited articulation of the shaft assembly 34 relative to the socket assembly 36. In this embodiment, the relative pivot of the spa cover and lifting device is a complex motion about the axis of the hinge pin 102. To releasably engage the shaft assembly 34 with the socket assembly 36, the pin 94 of the shaft assembly 34 is equipped with a pair of spring loaded buttons 104 spaced on the flat portion 100 of the pin 94. The spring loaded buttons engage a pair of complimentary recesses in the form of holes 106 in the flattened portion 92 of the tube segment 90. The arrangement shown in FIG. 4 is for purposes of illustration and the interconnection mechanism 44 upon assembly is arranged as shown in FIG. 5 with the pin 94 and tube segment 90 located within a cavity 106 in the foam core 66.

In the preferred embodiments of the spa cover and lift unit 10, the interconnection mechanism 44 is located at the sides 108 of the transported half-cover segment 46 adjacent the center fold 22 with the interconnection mechanism 44 and cross-support, U-channel 62 sealed by the casing 82.

Figure 7:
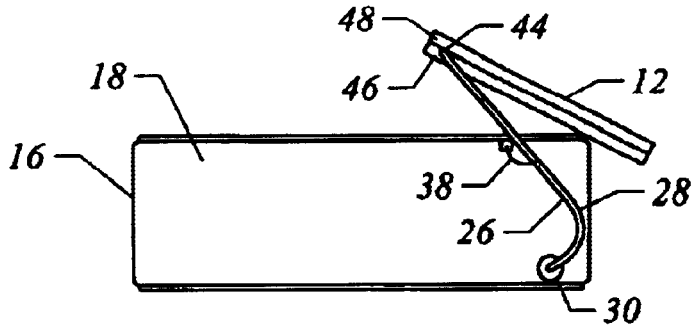
FIG. 7 is a side elevational view of the spa cover and lift unit installed on a spa structure illustrating a second position in displacing the folded spa cover from the spa structure.
Figure 8:
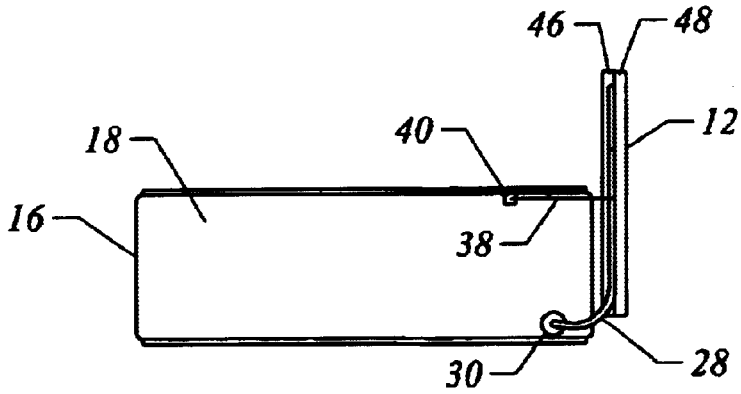
FIG. 8 is a side elevational view of the spa cover and lift unit installed on a spa structure illustrating a third storage position of the folded spa cover at the side of the spa structure.

In operation, the spa cover and lift unit 10 of this invention operates similar to the spa cover lifting device of patent 5,974,599, as schematically shown in FIGS. 6, 7 and 8. As schematically illustrated in FIG. 6, the carried segment 48 is folded on top of the transport or carrier segment 46. The carrier segment 46 is coupled to the side arm 28 on each side of the cover segment. One side arm is manually lifted to the position shown in FIG. 7. As the side arms 28 are further pivoted, the folded spa cover 12 is lowered to the side of the spa housing 18 and retained by the tether 38 in the vertical position illustrated. As reverse procedure is followed to reposition the folded spa cover over the perimeter top 20 of the spa 16 to the position shown in FIG. 6. From there, the carried cover segment 48 is simply folded away from the carrier segment 46 to complete the covering of the spa.

Referring now to FIGS. 9–13, an alternate embodiment of the spa cover and lift device 10 is shown. The alternate embodiment designated by the reference numeral 110 is adapted for installation on a spa 112 having an outer housing structure 114. The housing structure 114 is in the form of a cabinet 116 that typically conceals the plumbing for an inner water container 118, shown in part in FIG. 10. The housing structure 114 has an outside surface 120 on which mounting brackets are typically secured for pivot of the side arms located on opposite sides of the spa.

In the embodiment of FIGS. 9–13, a spa cover lifting device 121 having a pair of side arms 122 (one shown in FIG. 9) each arm having a distal end 124 that connects to a foldable spa cover 126 in a manner preferably identical to the shaft and socket arrangement described with reference to FIGS. 1–5. The side arms 122 are preferably configured with a telescoping upper end portion 130 and a lower mounting portion 132 that includes the forward fulcrum bend 134 for facilitating the lift and transport of the cover and the positioning of the cover in the storage position on one side of the spa as shown in FIGS. 6–8.

However, it is to be understood that the improved system of mounting the arms to a spa when combined with the improved system of connecting the arms to the cover permit a preinstallation of the concealed mounting brackets and therefore an integrated assembly of the spa cover 126, side arms 122 and spa 112. In such integrated arrangements the length and configuration of the side arms 122 are predetermined and the telescoping feature can be eliminated. Fabricating each side arm as a unitary member simplifies installation where the lift arms are sold separately from a spa and cover having preinstalled receiving components for the appropriately sized arms.

Figure 9:
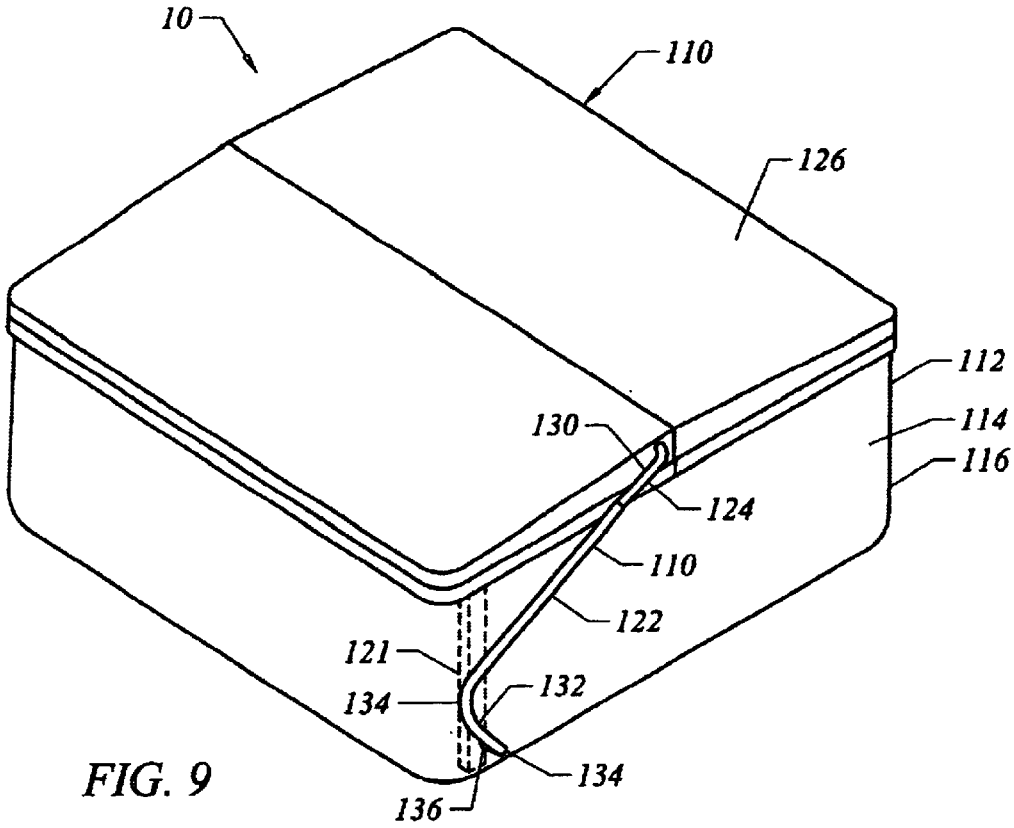
FIG. 9 is a perspective view of an alternate embodiment of the foldable spa cover and lift unit integrated with a spa structure having an outer housing structure.
Figure 10:
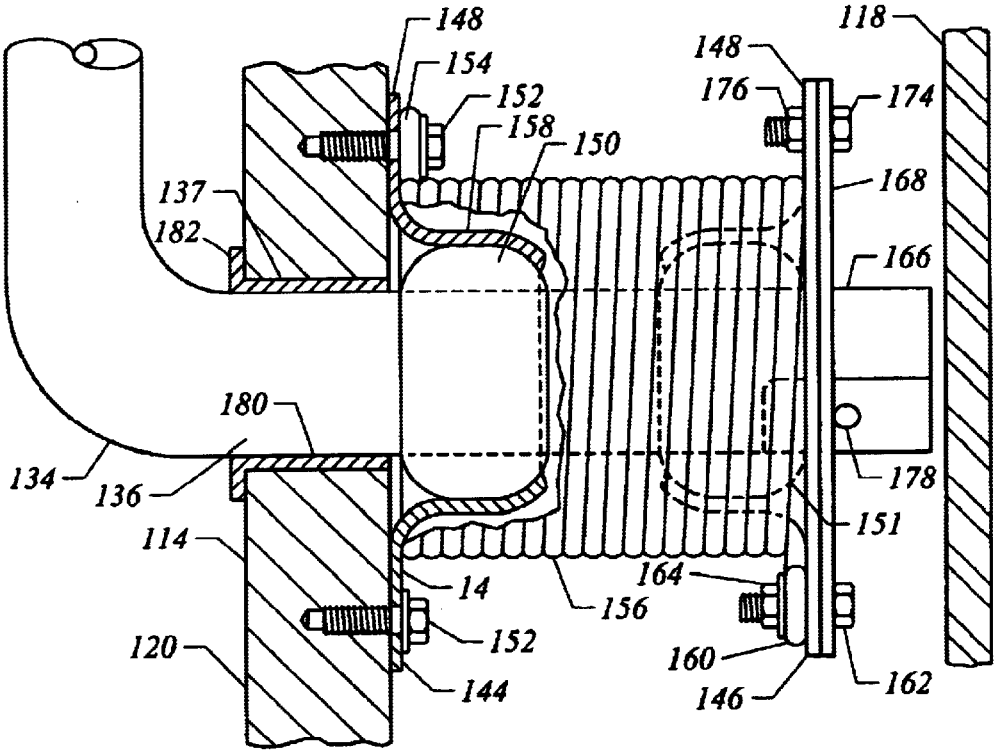
FIG. 10 is an enlarged side elevational view of the concealed mounting bracket on the alternate embodiment of the foldable spa cover and lift unit integrated with the spa structure of FIG. 9.

As shown in FIGS. 9 and 10, the lower mounting portion 132 of the arms 122 have a right angle bend 134 with an end segment 136 forming a pivot shaft 137 that engages a journal bearing bracket 138 mounted to a structural member 140 on the inside surface 142 of the housing structure 114.

Figure 11:
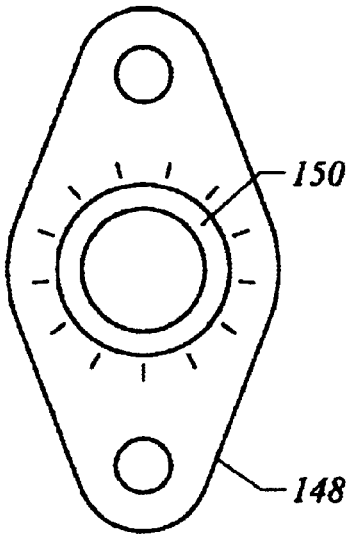
FIG. 11 is a front elevational view of a bushing member in the mounting bracket of FIG. 10.
Figure 12:
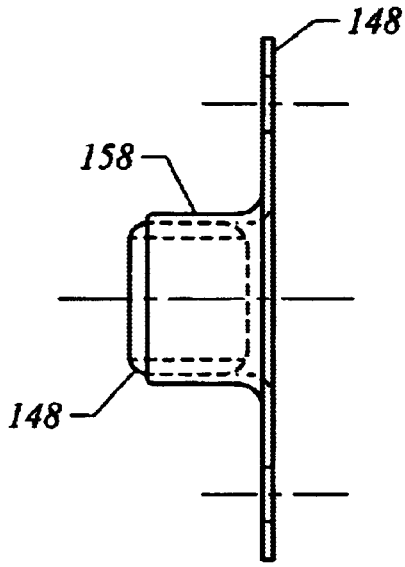
FIG. 12 is a side elevational view of the bushing member of FIG. 11.
Figure 13:
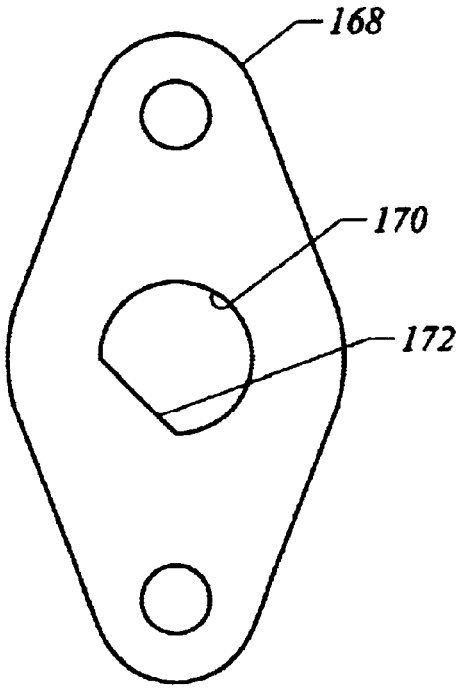
FIG. 13 is a front elevational view of a keyway plate in the mounting bracket of FIG. 10.

The journal bearing bracket 138 is constructed with oppositely facing nylon eyeball flanges 144 and 146 formed with press formed end plates 148 having projective neck portions 158 in which are press-fit nylon bearings 150 and 151 as shown in FIGS. 11 and 12. The end plate 148 of nylon eyeball flange 144 is secured to the housing structure 114 by screws 152, one of which secures one end 154 of coil spring 156.

The coil spring 156, encompasses the neck portions 158 of the end plates 148 and has an opposite end 160 secured to the end plate 148 of the floating eyeball flange 146 by a bolt 162 and nut 164. In order to take advantage of the coil spring 156 in lifting and lowering the spa cover 26, the pivot shaft 137 has a flat end portion 166 that engages a keyway plate 168 with a hole 170 having a corresponding flat 172 shown in FIG. 13.

The keyway plate 168 is coupled to the end plate 148 of the nylon eyeball flange 146 by the coil securing bolt 162 and nut 164 and a bolt 174 and nut 176 on the other side of the keyway plate 168 and nylon eyeball flange 146. In this manner, by proper selection of the coil spring 156 and orientation of the flat 172 in the keyway plate 168 the keyed arms 122 can be installed with the coil spring 156 providing a torsional assist in lifting and lowering a connected cover.

Preferably, to prevent dislodgement of the pivot shaft, a spring loaded ball 178 in the end portion 166 projects against the keyway plate 168. As shown in FIG. 10, the housing structure 114 has a pre-formed hole 180 that may be blocked with a removable plug which is replaced with a bushing 182 allowing the lift arms 122 to be later added to the spa as an accessory. Since the lift device is preferably tailored to a specific cover and spa combination, the cover and spa can be sold without the lift device with the connecting lift hardware pre-installed and the socket holes blocked by removable plugs. Later addition of the lift arms is facilitated by the pre-installed interconnection hardware allowing the arms to be positioned to engage the keyways in the sockets and snapped into place.

It is to be understood that the key embodiments of the spa cover and lift unit disclose alternate means of implementing the operational features that render the spa cover and lift unit of this invention a desirable improvement over the unique lifting devices disclosed in my U.S. Pat. Nos. 5,974,599 and 6,158,063.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A foldable spa cover and lift unit for installation on a spa having a housing structure with an outside surface an inside surface, sides and a top, the lift unit comprising:

spa cover having first and second half-cover segments interconnected by a center fold; each half-cover segment having a top and sides;

a spa cover lifting device having side arms with a lower portion pivotally connectable to opposite sides of the spa, the arms each having a distal end;

an interconnection mechanism for pivotally connecting the side arms of the lifting device to the first half-cover segment of the spa cover adjacent to the center fold, wherein the interconnection mechanism includes a shaft assembly at the distal ends of the side arms and the first half-cover segment includes a socket assembly on opposite sides of the first half-cover segment, wherein the shaft assembly and socket assembly have releasable engagement means for realeaseably connecting the shaft assembly to the socket assembly for pivot of the spa cover to a storage position when the spa cover and lift unit is installed on a spa structure and the arms of the lift device are pivoted to the side of the spa structure; and a pair of journal bearing brackets mountable to the inside surface of the housing structure at opposite sides of the spa, wherein the journal brackets each have a bearing and the side arms each have a bend with an end segment with a pivot shaft engageable with the bearing of the journal brackets.

2. The foldable spa cover and lift unit of claim 1, wherein one of the shaft assembly and the socket assembly have a keyway and the other of the shaft assembly and the socket assembly is keyed to the keyway.

3. The foldable spa cover and lift unit of claim 2, wherein the socket assembly has a tube segment with a flat portion and the shaft assembly has a pin insertable into the tube segment, the pin having a flat portion complimentary to the flat portion of the tube segment wherein the pin of the shaft assembly is keyed to the tube segment of the socket assembly by alignment of the flat portion of the pin with the flat portion of the tube segment.

4. The foldable spa cover and lift unit of claim 3, wherein the socket assembly on each side of the first half-cover segment has a mounting structure in the first half-cover segment and the two cover segments are hingedly connected to the mounting structure.

5. The foldable spa cover and lift unit of claim 4, wherein the tube segments each have a hinge structure and the first half-cover segment has a rigid cross-member from one side of the first half-cover segment to the opposite side with the hinge structures of the tube segments mounted to the rigid cross-member.

6. The foldable spa cover and lift unit of claim 5, wherein the rigid cross-member comprises a U-channel embedded in the first half-cover segment adjacent the center fold.

7. The foldable spa cover and lift unit of claim 6, wherein the first and second half-cover segments have a core of thick insulating material and the U-channel is embedded in the core, the core having a cavity for displacement of the hinged tube segments of the socket assembly.

8. The foldable spa cover and lift unit of claim 3, wherein the flat portion of each pin of the shaft assembly has a spring loaded button and the flat portion of each tube segment has a recess complementary to the spring loaded button wherein the spring loaded buttons of the pins seat in the recesses of the tube segment when the pins are inserted into the tube segments.

9. The foldable spa cover and lift unit of claim 8, wherein each pin has a plurality of spring loaded buttons and each tube segment has a plurality of complementary recesses.

10. The foldable spa cover and lift unit of claim 8, wherein the recesses comprise holes.

11. The foldable spa cover and lift unit of claim 2, wherein the socket assembly has a tube segment and the shaft assembly has a pin insertable in the tube segment, wherein one of the tube segment and pin has a projecting key and the other of the tube segment and pin has a complementary groove, wherein the pin is insertable into the tube segment when the key and groove are aligned.

12. The foldable spa cover and lift unit of claim 11, wherein the releasable engagement means comprises an O-ring in the tube segment engageable in a groove around the pin.

13. The foldable spa cover and lift unit of claim 12, wherein the pin includes a constricted portion in which the key is positioned when the pin is inserted into the tube segment.

14. The foldable spa cover of claim 13, wherein the pivot shaft has and end flat and the journal bracket has a keyway plate connected to the coil spring with a hole having a matching flat in the plate, wherein the pivot shaft engages the plate through the hole with the end flat and plate flat causing rotation of the keyway plate and coil spring on pivot of the side arms.

15. The foldable spa cover of claim 14, wherein the eyeball flanges include nylon bearings.

16. The foldable spa cover and lift unit of claim 1, wherein the pin and tube segment have cooperating means for pivot of the pin relative to the tube segment when the pin is inserted into the tube segment.

17. The foldable spa cover and lift unit of claim 1, wherein the journal brackets each include a coil spring that engages the pivot shaft of the side arm and torsionally facilitates lifting and lowering of the spa cover.

18. The foldable spa cover of claim 17, wherein the journal brackets include oppositely facing eyeball flanges wherein one flange is connected to the inside surface of the spa housing structure and the other flange is connected to the keyway plate.

* * * * *